US011478055B2

(12) United States Patent
Chatman

(10) Patent No.: US 11,478,055 B2
(45) Date of Patent: Oct. 25, 2022

(54) MAIL CARRIER APPARATUS

(71) Applicant: Christopher Chatman, Villa Park, IL (US)

(72) Inventor: Christopher Chatman, Villa Park, IL (US)

( * ) Notice: Subject to any disclaimer, the term of this patent is extended or adjusted under 35 U.S.C. 154(b) by 348 days.

(21) Appl. No.: 16/816,979

(22) Filed: Mar. 12, 2020

(65) Prior Publication Data

US 2021/0282519 A1 Sep. 16, 2021

(51) Int. Cl.
*A45C 13/02* (2006.01)
*B43K 25/02* (2006.01)

(52) U.S. Cl.
CPC ..... *A45C 13/02* (2013.01); *B43K 25/026* (2013.01)

(58) Field of Classification Search
CPC .... A45C 13/02; B43K 25/026; A47B 23/042; A47B 23/02
USPC ..... 232/45; 206/575; 24/67.5, 67.7; 248/452, 453, 451
See application file for complete search history.

(56) References Cited

U.S. PATENT DOCUMENTS 1,560,493 A * 11/1925 Steinberg ..... B43M 99/008 211/69.1
2,721,596 A 10/1955 Danneil
2,797,935 A * 7/1957 Carney ..... B60R 7/08 206/232
2,799,967 A * 7/1957 Molinari ..... B60N 3/002 312/246
2,862,328 A * 12/1958 Wadsworth ..... B64D 11/06 248/447.2
2,876,022 A * 3/1959 Kroviak ..... B42F 9/001 24/301
3,246,914 A * 4/1966 Goodwin ..... B42F 9/001 24/67.5
3,587,795 A 6/1971 Berry
3,968,546 A * 7/1976 Seaborn ..... B42F 1/00 24/67.11
4,236,615 A 12/1980 Ginat
4,274,567 A * 6/1981 Sawyer ..... A45C 15/02 224/570
4,896,927 A * 1/1990 Liu ..... B42F 9/001 24/67.11
4,907,824 A * 3/1990 Smirnoff ..... B42D 1/008 283/117
5,000,327 A * 3/1991 Kincheloe ..... B43K 23/002 D6/567
5,058,242 A * 10/1991 Liu ..... B42F 9/001 24/67 R (Continued)

FOREIGN PATENT DOCUMENTS

EP 0487375 11/1991

*Primary Examiner* — Chun Hoi Cheung

(57) ABSTRACT

A mail carrier apparatus for carrying and organizing mail for delivery includes a board having a board front face, a board back face, a board top edge, a board bottom edge, a board left edge, and a board right edge. The board has an upper portion and a lower portion. A mail bin is coupled to the board back face. The mail bin comprises a bin left side, a bin right side, a bin back side, and a bin bottom side defining a bin cavity with the upper portion of the board back face to hold mail. A ledge is coupled to the board. The ledge is coupled to the board front face proximal the board bottom edge. The ledge supports magazines and larger envelopes resting against the board.

9 Claims, 5 Drawing Sheets

(56) References Cited

U.S. PATENT DOCUMENTS

| | | | | |
|---|---|---|---|---|
| 5,143,188 | A | 9/1992 | Robinet | |
| 5,183,153 | A * | 2/1993 | Linn | G09F 3/18 206/38.1 |
| 5,324,076 | A * | 6/1994 | Nieradka | B42D 5/006 248/441.1 |
| 5,360,342 | A * | 11/1994 | Pardner | B43L 3/00 434/84 |
| D382,898 | S * | 8/1997 | Chang | D19/20 |
| D429,883 | S | 8/2000 | Roonan | |
| 6,095,477 | A * | 8/2000 | Pohlman | B60R 11/00 248/452 |
| 6,425,567 | B2 * | 7/2002 | Schutze | A47B 19/06 248/452 |
| 7,871,051 | B2 * | 1/2011 | Schuermann | B62B 3/1428 248/456 |
| 8,522,939 | B2 | 9/2013 | Rowe | |
| 9,168,779 | B2 * | 10/2015 | Krapf | B43L 3/00 |
| 2005/0098702 | A1 * | 5/2005 | Ibara | A47B 23/06 248/441.1 |
| 2006/0186299 | A1 * | 8/2006 | Shields | A47B 23/042 248/316.7 |
| 2009/0084924 | A1 * | 4/2009 | Schuermann | B62B 3/1428 248/452 |
| 2010/0269763 | A1 | 10/2010 | Kraft | |
| 2011/0168865 | A1 * | 7/2011 | Magaudda | A47B 23/06 248/452 |

* cited by examiner

MAIL CARRIER APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to mail delivery devices and more particularly pertains to a new mail delivery device for carrying and organizing mail for delivery.

(2) Description of Related Art Including Information Disclosed Under 37 CFR 1.97 and 1.98

The prior art relates to mail delivery devices and carry bags. Existing devices for delivering mail are typically messenger-style bags and may have different compartments for organization yet do not allow the mail carrier to easily see and separate what has been sorted. These devices also do not lend themselves to be supported with one arm in front of the carrier while the other hand easily identifies and separates mail for delivery.

BRIEF SUMMARY OF THE INVENTION

An embodiment of the disclosure meets the needs presented above by generally comprising a board having a board front face, a board back face, a board top edge, a board bottom edge, a board left edge, and a board right edge. The board has an upper portion and a lower portion. A mail bin is coupled to the board back face. The mail bin comprises a bin left side, a bin right side, a bin back side, and a bin bottom side defining a bin cavity with the upper portion of the board back face. The bin cavity is configured to hold mail. A ledge is coupled to the board. The ledge is coupled to the board front face proximal the board bottom edge. The ledge is configured to support magazines and larger envelopes resting against the board.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
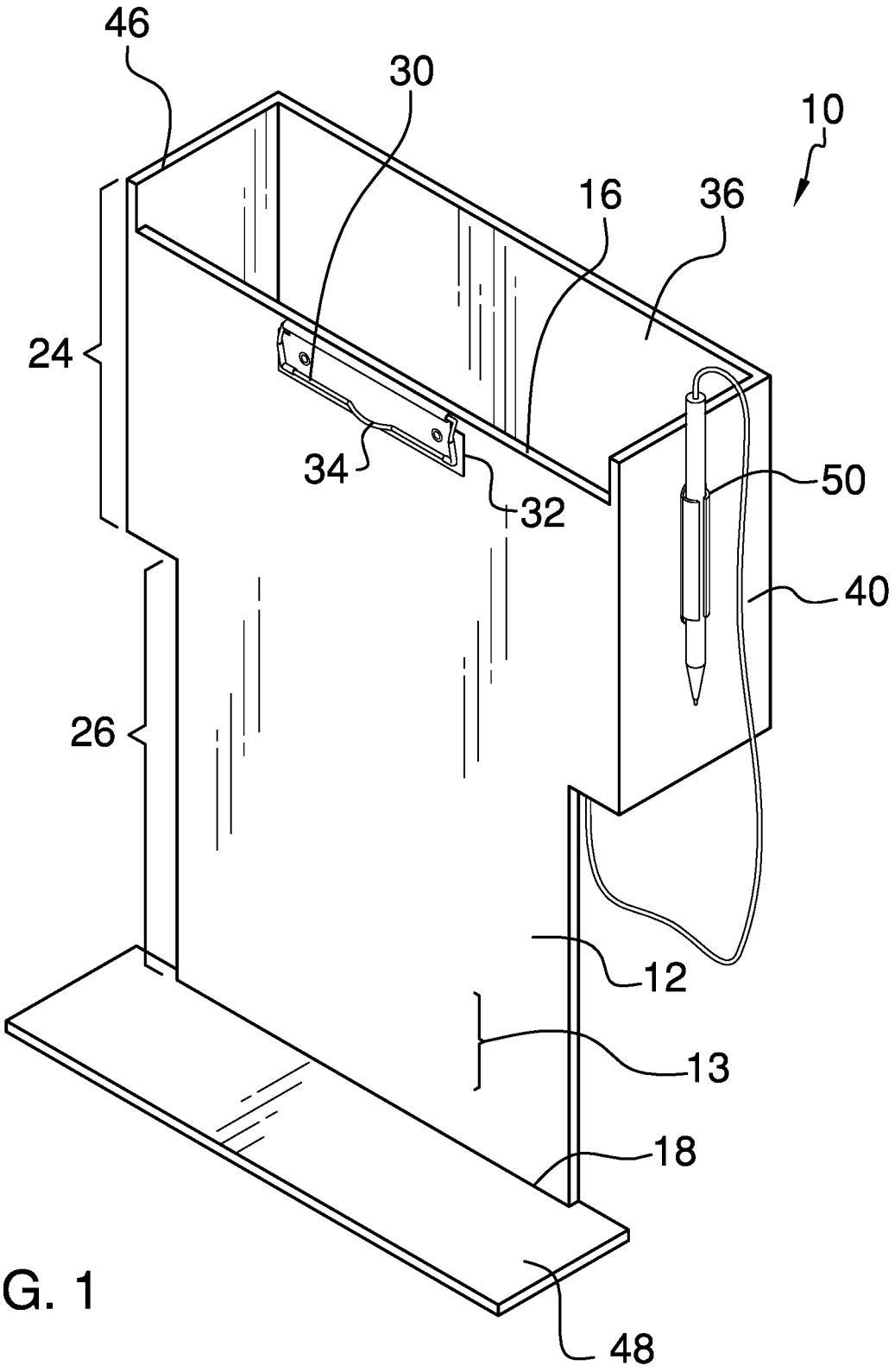
FIG. 1 is an isometric view of a mail carrier apparatus according to an embodiment of the disclosure.
Figure 2:
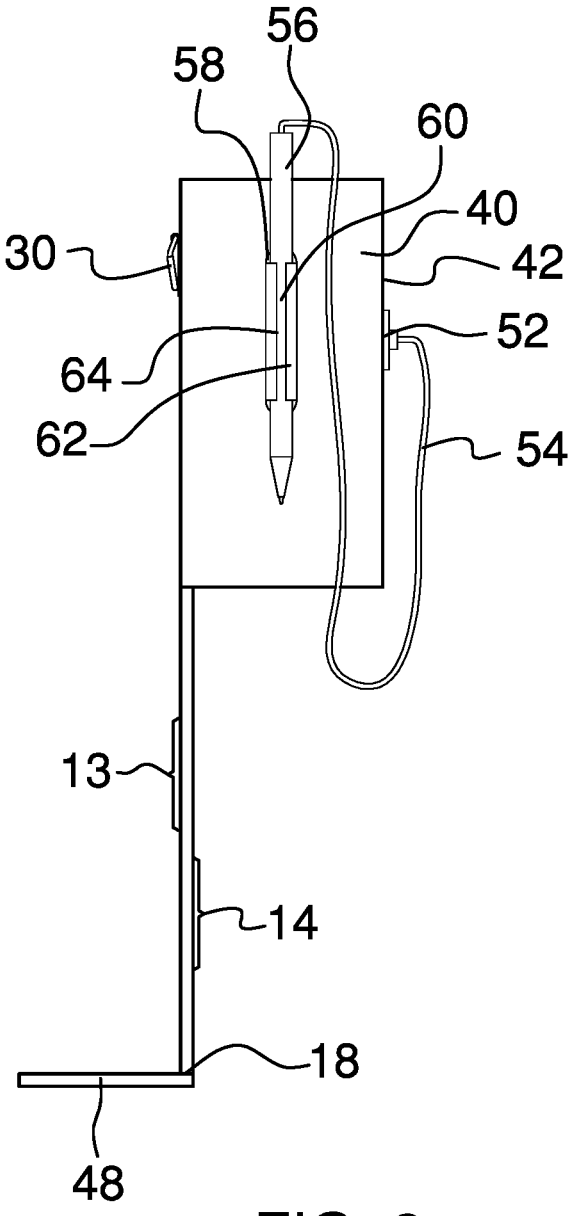
FIG. 2 is a side elevation view of an embodiment of the disclosure.
Figure 3:
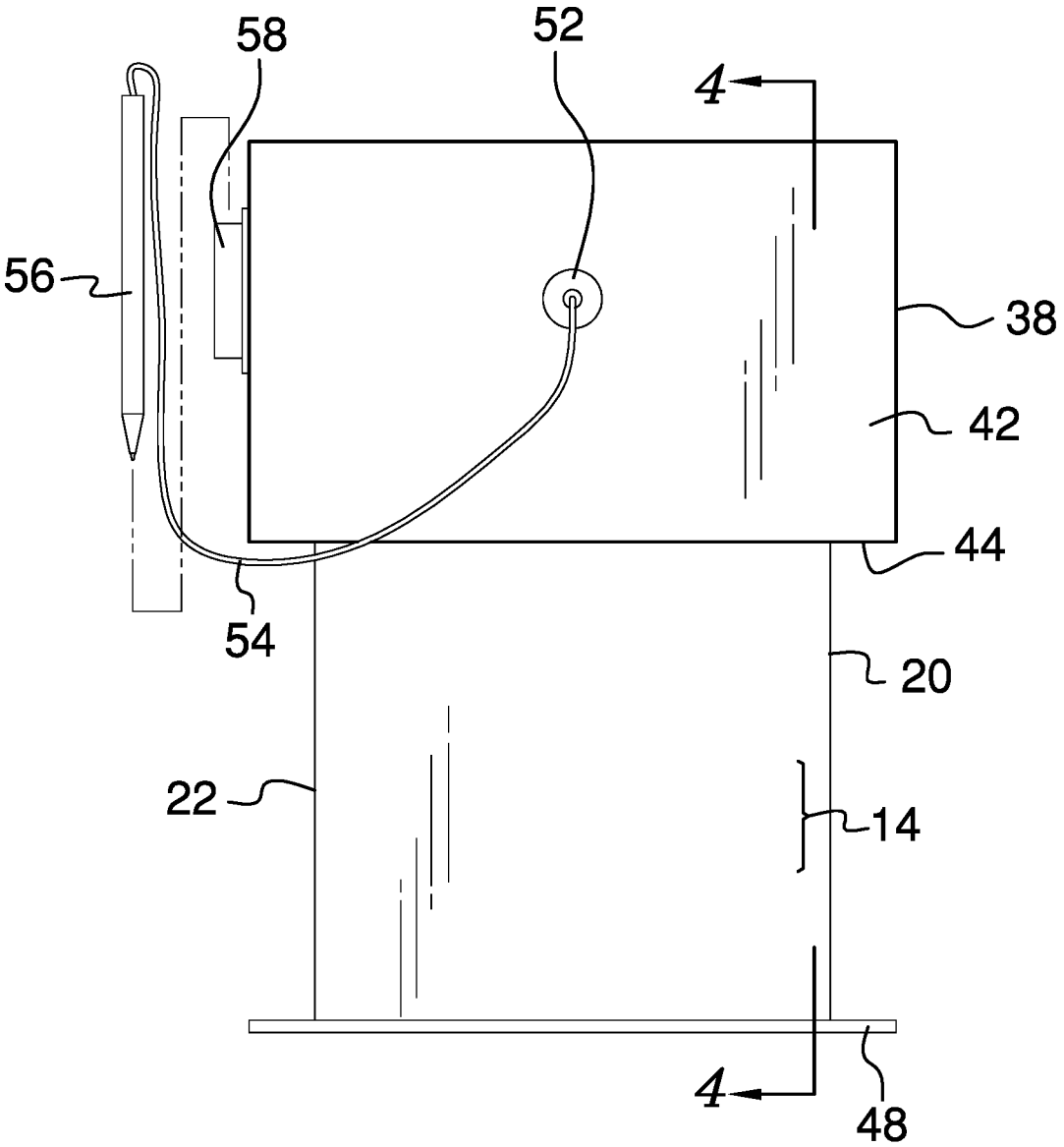
FIG. 3 is a rear elevation view of an embodiment of the disclosure.
Figure 4:
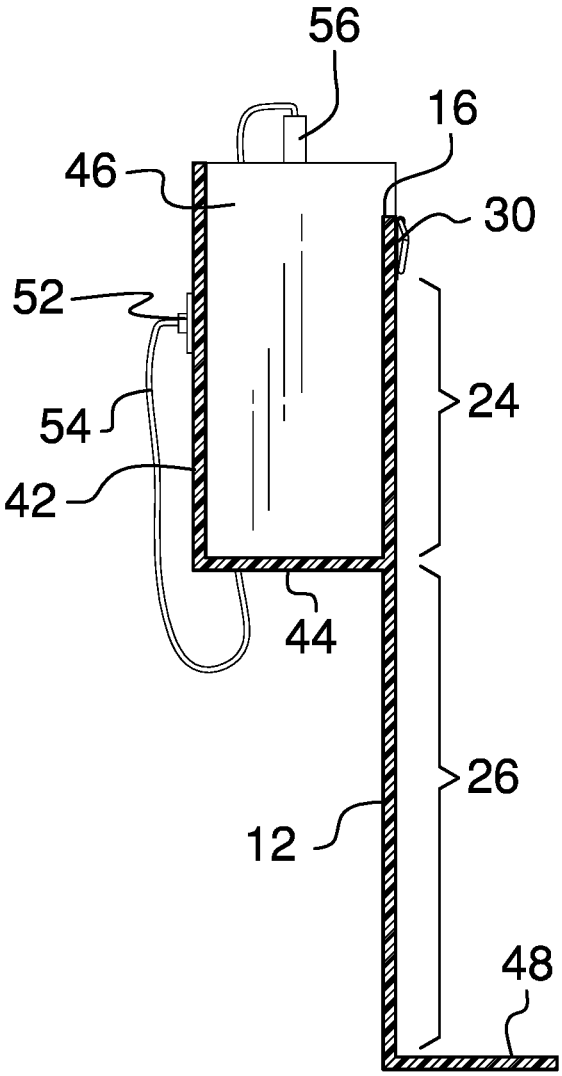
FIG. 4 is a cross-sectional view of an embodiment of the disclosure along the line 4-4 of FIG. 3.

With reference now to the drawings, and in particular to FIGS. 1 through 5 thereof, a new mail delivery device embodying the principles and concepts of an embodiment of the disclosure and generally designated by the reference numeral 10 will be described.

As best illustrated in FIGS. 1 through 5, the mail carrier apparatus 10 generally comprises a board 12 having a board front face 13, a board back face 14, a board top edge 16, a board bottom edge 18, a board left edge 20, and a board right edge 22. The board 12 has an upper portion 24 and a lower portion 26. The width of the upper portion 24 of the board may be greater than the width of the lower portion 26 of the board making the board 12 a capital T-shape. The board 12 may be dimensioned such that a standard size magazine 28 extends from the board bottom edge 18 and covers the lower portion 26 but does not entirely cover the upper portion 24. The width of the lower portion 26 is dimensioned to conform to the width of standard size magazine 28.

A clip 30 may be coupled to the board front face 13 proximal the board top edge 16. The clip 30 may include a clip mount 32 coupled to the board front face 13 and a clip arm 34 pivotably coupled to the clip mount 32. The clip arm 34 is spring-loaded to bias towards a clamped position contacting the clip mount 32. The clip 30 is configured to hold mail against the board 12.

Figure 5:
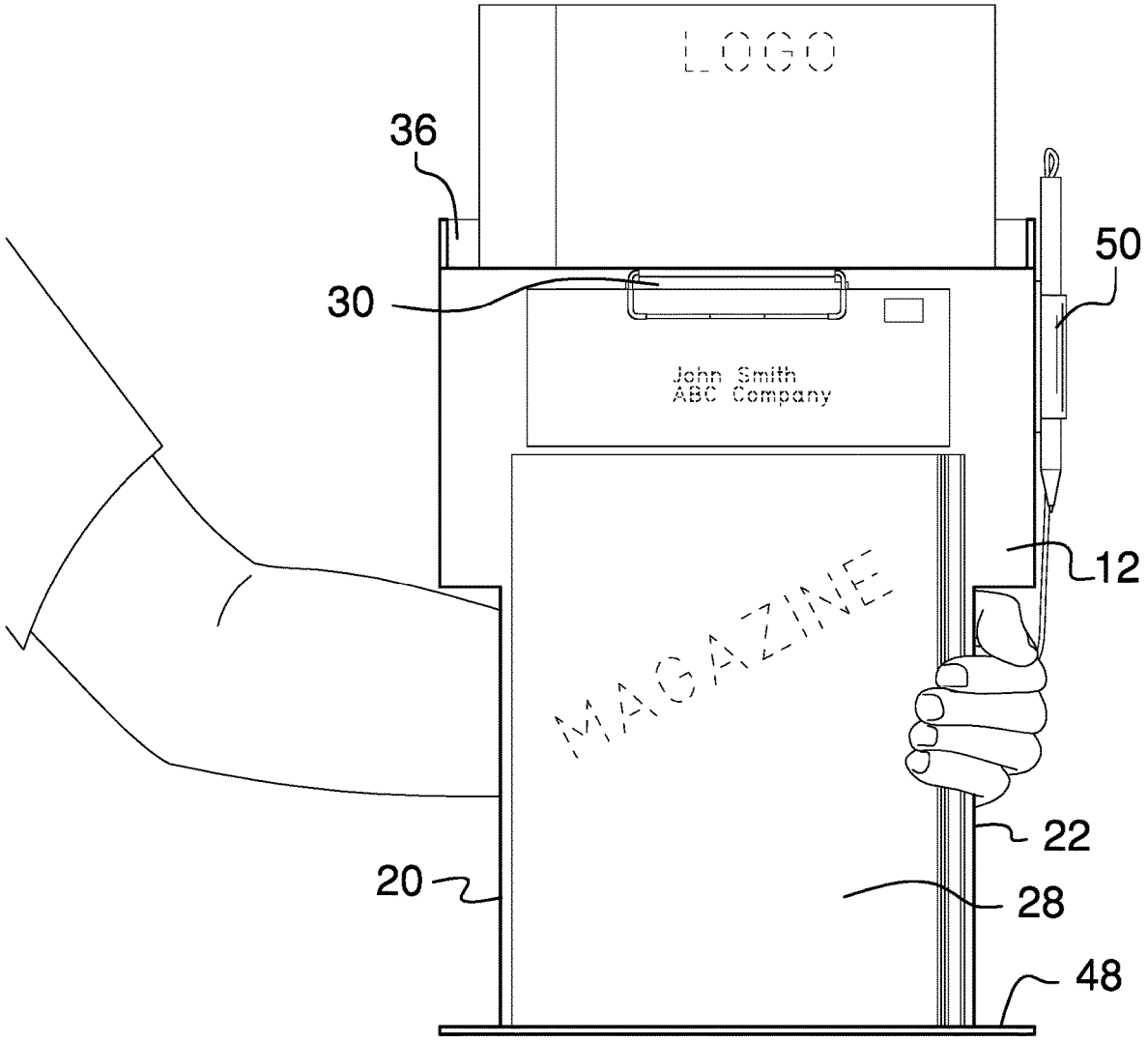
FIG. 5 is an in-use view of an embodiment of the disclosure.

A mail bin 36 is coupled to the board back face 14. The mail bin 36 comprises a bin left side 38, a bin right side 40, a bin back side 42, and a bin bottom side 44 defining a bin cavity 46 with the upper portion 24 of the board back face 14. The bin cavity 46 is configured to hold mail. Each of the bin left side 38, the bin right side 40, and the bin back side 42 may extend above the board top edge 16 to support larger envelopes and magazines without obstructing visibility or accessibility of standard sized envelopes held within the bin cavity 46. The bin bottom side 44 of the mail bin may additionally serve as a support point on the forearm of a user securing the apparatus 12 as shown in FIG. 5.

A ledge 48 is coupled to the board 12. The ledge 48 is coupled to the board front face 13 proximal the board bottom edge 18 and may extend perpendicularly. The width of the ledge 48 may be equal to the width of the upper portion 24 of the board. The ledge 48 is configured to support magazines and larger envelopes resting against the board 12. The ledge 48 may have a lip to prevent items from slipping. A pen attachment 50 is coupled to the mail bin 36. The pen attachment 50 may include a pen anchor 52 coupled to the bin back side 42 of the mail bin, a pen cord 54 coupled to the pen anchor 52, a pen 56 coupled to the pen cord 54, and a pen holder 58 coupled to the bin right side 40 of the mail bin. The pen 56 is selectively engageable within the pen holder 58 for storage when not in use. The pen holder 58 may be tubular and may have a split channel 60 to allow a holder back side 62 and a holder front side 64 to elastically separate and secure the pen 56 when inserted. The pen cord 54 and the pen anchor 52 prevent the pen 56 from falling if dropped.

In use, mail is placed in the bin cavity 46 of the mail bin. The user secures the apparatus 10 with his or her forearm on the board back face 14 beneath the bin bottom side 44 and his or her hand securing the lower portion 26 of the board 12. The next delivery may then be selected and organized by placing larger items on the ledge 48 and smaller items under the clip 30. The pen 56 is easily accessed when needed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A mail carrier apparatus comprising:

a board having a board front face, a board back face, a board top edge, a board bottom edge, a board left edge, and a board right edge, the board having an upper portion and a lower portion;

a mail bin coupled to the board back face, the mail bin comprising a bin left side, a bin right side, a bin back side, and a bin bottom side defining a bin cavity with the upper portion of the board back face, the bin cavity being configured to hold mail, each of the bin left side, the bin right side, and the bin back side extending above the board top edge, the board top edge being coextensive with bin top front edge wherein said bin is open along a top front of said bin; and a ledge coupled to the board, the ledge being coupled to the board front face proximal the board bottom edge, the ledge being configured to support magazines and larger envelopes resting against the board.

2. The mail carrier apparatus of claim 1 further comprising a clip coupled to the board, the clip being coupled to the board front face proximal the board top edge.

3. The mail carrier apparatus of claim 2 further comprising the clip including a clip mount coupled to the board front face and a clip arm pivotably coupled to the clip mount, the clip arm being spring-loaded to bias towards a clamped position contacting the clip mount.

4. The mail carrier apparatus of claim 1 further comprising a pen attachment coupled to the mail bin, the pen attachment including a pen anchor coupled to the mail bin, a pen cord coupled to the pen anchor, and a pen coupled to the pen cord.

5. The mail carrier apparatus of claim 4 further comprising the pen attachment including a pen holder coupled to the mail bin, the pen being selectively engageable within the pen holder.

6. The mail carrier apparatus of claim 5 further comprising the pen anchor being coupled to the bin back side and the pen holder being coupled to the bin right side.

7. The mail carrier apparatus of claim 1 further comprising the width of the upper portion of the board being greater than the width of the lower portion of the board.

8. The mail carrier apparatus of claim 7 further comprising the width of the ledge being equal to the width of the upper portion of the board.

9. A mail carrier apparatus comprising:

a board having a board front face, a board back face, a board top edge, a board bottom edge, a board left edge, and a board right edge, the board having an upper portion and a lower portion, the width of the upper portion of the board being greater than the width of the lower portion of the board;

a clip coupled to the board, the clip being coupled to the board front face proximal the board top edge, the clip including a clip mount coupled to the board front face and a clip arm pivotably coupled to the clip mount, the clip arm being spring-loaded to bias towards a clamped position contacting the clip mount;

a mail bin coupled to the board back face, the mail bin comprising a bin left side, a bin right side, a bin back side, and a bin bottom side defining a bin cavity with the upper portion of the board back face, each of the bin left side, the bin right side, and the bin back side extending above the board top edge, the bin cavity being configured to hold mail;

a ledge coupled to the board, the ledge being coupled to the board front face proximal the board bottom edge, the width of the ledge being equal to the width of the upper portion of the board, the ledge being configured to support magazines and larger envelopes resting against the board; and a pen attachment coupled to the mail bin, the pen attachment including a pen anchor coupled to the bin back side of the mail bin, a pen cord coupled to the pen anchor, a pen coupled to the pen cord, and a pen holder coupled to the bin right side of the mail bin, the pen being selectively engageable within the pen holder.

* * * * *